US012270403B2

(12) United States Patent
Sawada

(10) Patent No.: US 12,270,403 B2
(45) Date of Patent: Apr. 8, 2025

(54) BLOWER AND INDOOR UNIT

(71) Applicant: FUJITSU GENERAL LIMITED, Kanagawa (JP)

(72) Inventor: Hirotaka Sawada, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 42 days.

(21) Appl. No.: 18/277,155

(22) PCT Filed: Mar. 2, 2022

(86) PCT No.: PCT/JP2022/008890
§ 371 (c)(1),
(2) Date: Aug. 14, 2023

(87) PCT Pub. No.: WO2022/209551
PCT Pub. Date: Oct. 6, 2022

(65) Prior Publication Data

US 2024/0117810 A1 Apr. 11, 2024

(30) Foreign Application Priority Data

Mar. 31, 2021 (JP) ..... 2021-061997

(51) Int. Cl.
*F04D 17/04* (2006.01)
*F04D 29/42* (2006.01)
(Continued)

(52) U.S. Cl.
CPC ..... *F04D 17/04* (2013.01); *F04D 29/422* (2013.01); *F04D 29/663* (2013.01); *F24F 1/0025* (2013.01)

(58) Field of Classification Search
CPC ..... F04D 17/04; F04D 29/663; F04D 29/283; F04D 29/422; F04D 29/5826; F24F 1/0025
See application file for complete search history.

(56) References Cited

U.S. PATENT DOCUMENTS

2008/0181764 A1* 7/2008 Hirakawa ..... F24F 1/0057 415/53.2
2015/0285525 A1 10/2015 Nakai et al.

FOREIGN PATENT DOCUMENTS

EP 1780475 A2 * 5/2007 ..... F24F 1/0007
EP 2902632 A1 8/2015
(Continued)

OTHER PUBLICATIONS

Honjo, English Translation of WO2008041627, 2008 (Year: 2008).*

*Primary Examiner* — Michael K. Reitz
(74) *Attorney, Agent, or Firm* — Paratus Law Group, PLLC

(57) ABSTRACT

A blower includes a cross flow fan, a mechanism configured to rotate the cross flow fan about a rotation axis, a front tongue part that is arranged in front of the cross flow fan, and a back tongue part that is arranged in back of the cross flow fan, wherein a front fan facing surface of the front tongue part faces the cross flow fan, and includes a plurality of front non-flat portions on which non-flatness is formed, and a plurality of front flat portions on which no non-flatness formed, a back fan facing surface of the back tongue part faces the cross flow fan, and includes a plurality of back non-flat portions on which non-flatness formed, and a plurality of back flat portions on which no non-flatness is formed, and the back non-flat portions respectively face the front flat portions and the back flat portions respectively face the front non-flat portions.

7 Claims, 5 Drawing Sheets

(51) Int. Cl.
*F04D 29/66* (2006.01)
*F24F 1/0025* (2019.01)

(56) References Cited

FOREIGN PATENT DOCUMENTS

| | | | | | |
|---|---|---|---|---|---|
| EP | 2918924 | A1 | | 9/2015 | |
| EP | 2957773 | A1 | * | 12/2015 | ..... F04D 17/04 |
| JP | S62-118095 | A | | 5/1987 | |
| JP | 2014-070519 | A | | 4/2014 | |
| JP | 2014-070755 | A | | 4/2014 | |
| JP | 2014-070756 | A | | 4/2014 | |
| JP | 2014-152724 | A | | 8/2014 | |
| JP | 2014-190543 | A | | 10/2014 | |
| WO | WO 2006/038442 | A1 | | 4/2006 | |
| WO | WO-2008041627 | A1 | * | 4/2008 | ..... F24F 1/0007 |

* cited by examiner

BLOWER AND INDOOR UNIT

CROSS REFERENCE TO PRIOR APPLICATION

This application is a National Stage Patent Application of PCT International Patent Application No. PCT/JP2022/008890 (filed on Mar. 2, 2022) under 35 U.S.C. § 371, which claims priority to Japanese Patent Application No. 2021-061997 (filed on Mar. 31, 2021), which are all hereby incorporated by reference in their entirety.

FIELD

Techniques in the present disclosure relate to blowers and indoor units.

BACKGROUND

A known indoor unit of an air conditioner is provided with a blower that blows air by rotating a cross flow fan including a plurality of blades. Casings to store cross flow fans include tongue parts arranged near the cross flow fans (Patent Literature 1 to Patent Literature 5). These tongue parts have various protrusions and recesses formed thereon for reduction of blade pitch noise generated between the cross flow fans and the tongue parts.

CITATION LIST

Patent Literature

Patent Literature 1: Japanese Laid-open Patent Publication No. 2014-070519
Patent Literature 2: Japanese Laid-open Patent Publication No. 2014-070756
Patent Literature 3: Japanese Laid-open Patent Publication No. 2014-070755
Patent Literature 4: Japanese Laid-open Patent Publication No. 2014-152724
Patent Literature 5: Japanese Laid-open Patent Publication No. 2014-190543

SUMMARY

Technical Problem

Such a blower has a problem that surging is caused and the blowing performance is degraded when the flow rate of air blown is included in a certain range.

The techniques disclosed herein have been achieved in view of the above and an object thereof is to provide a blower and an indoor unit that have: less noise generated between their cross flow fan and their tongue parts, the noise being attributable to their blade pitch; and blowing performance that is less degraded.

Solution to Problem

According to an aspect of an embodiment, a blower includes a cross flow fan, a mechanism configured to rotate the cross flow fan about a rotation axis, a front tongue part that is arranged in front of the cross flow fan, and a back tongue part that is arranged in back of the cross flow fan, wherein a front fan facing surface of the front tongue part, the front fan facing surface facing the cross flow fan, includes: a plurality of front non-flat portions on which non-flatness is formed, and a plurality of front flat portions on which no non-flatness formed, a back fan facing surface of the back tongue part, the back fan facing surface facing the cross flow fan, includes: a plurality of back non-flat portions on which non-flatness formed, and a plurality of back flat portions on which no non-flatness formed, the plurality of back non-flat portions respectively face the plurality of front flat portions, with the cross flow fan interposed between the plurality of back non-flat portions and the plurality of front flat portions, and the plurality of back flat portions respectively face the plurality of front non-flat portions, with the cross flow fan interposed between the plurality of back flat portions and the plurality of front non-flat portions.

Advantageous Effects of Invention

A blower and an indoor unit disclosed herein enable both suppression of increase in noise level and suppression of degradation of blowing performance.

DESCRIPTION OF EMBODIMENTS

A blower and an indoor unit according to an embodiment disclosed by the present application will hereinafter be described by reference to the drawings. The techniques in the present disclosure are not limited by the following description. Furthermore, in the following description, the same reference sign will be assigned to components that are the same and redundant description thereof will be omitted.

Embodiment

Figure 1:
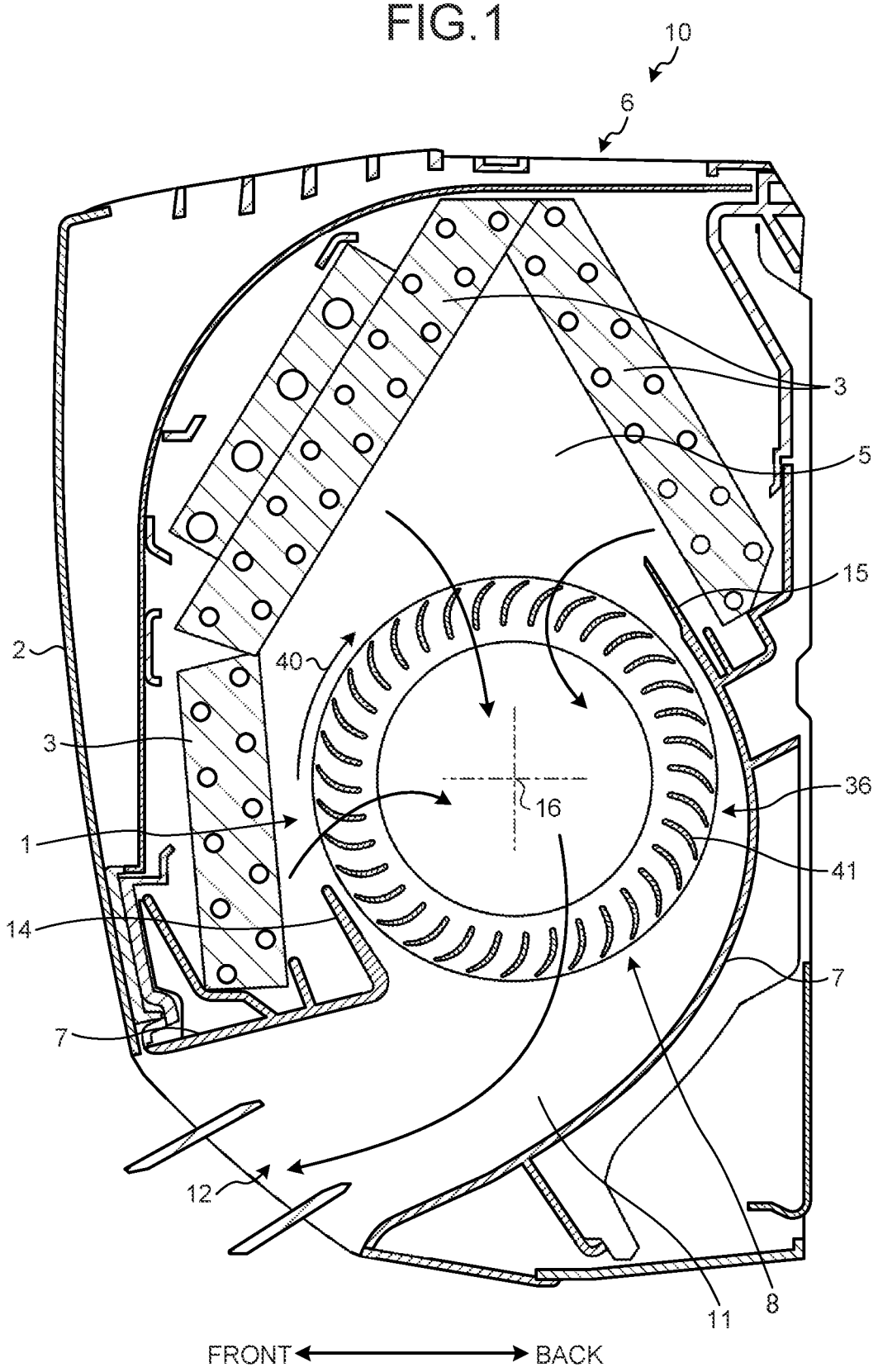
FIG. 1 is a sectional view of an indoor unit provided with a blower of an embodiment.

A blower 1 of an embodiment is provided in an indoor unit 10 of an air conditioner, as illustrated in FIG. 1. FIG. 1 is a sectional view of the indoor unit 10 provided with the blower 1 of the embodiment. The air conditioner includes the indoor unit 10 and includes an outdoor unit not illustrated in the drawings. The outdoor unit is installed outdoors. The indoor unit 10 is installed on a wall surface of an air conditioned room separated from the open air. The indoor unit 10 includes the blower 1, a casing 2, and a heat exchanger 3. The casing 2 has an air passage 5 formed inside the casing 2. An upper portion of the casing 2 has, formed therein, an inlet 6 that provides communication between the air passage 5 and the outside of the casing 2. The heat exchanger 3 is arranged in the air passage 5. The blower 1 is arranged in a lower region of the inside of the casing 2 and is arranged in a region downstream from the heat exchanger 3, the region being in the air passage 5.

The blower 1 includes a fan casing 7 and a cross flow fan 8. The fan casing 7 is arranged in a region downstream from the heat exchanger 3, the region being in the air passage 5, and is fixed to the casing 2 or formed integrally with the casing 2. The fan casing 7 has a blowing passage 11 and an outlet 12, formed therein. The blowing passage 11 is formed inside the fan casing 7. One end of the blowing passage 11 is connected to a region between the blower 1 and the heat exchanger 3, the region being in the air passage 5. The outlet 12 is arranged at a lower end of the fan casing 7. The other end of the blowing passage 11 is connected to the outlet 12 and connected to the outside of the casing 2 of the indoor unit 10 via the outlet 12.

The cross flow fan 8 is arranged in the blowing passage 11. The fan casing 7 includes a front tongue part 14 and a back tongue part 15. The front tongue part 14 is arranged in front of the blowing passage 11. The back tongue part 15 is arranged in back of the blowing passage 11.

Figure 2:
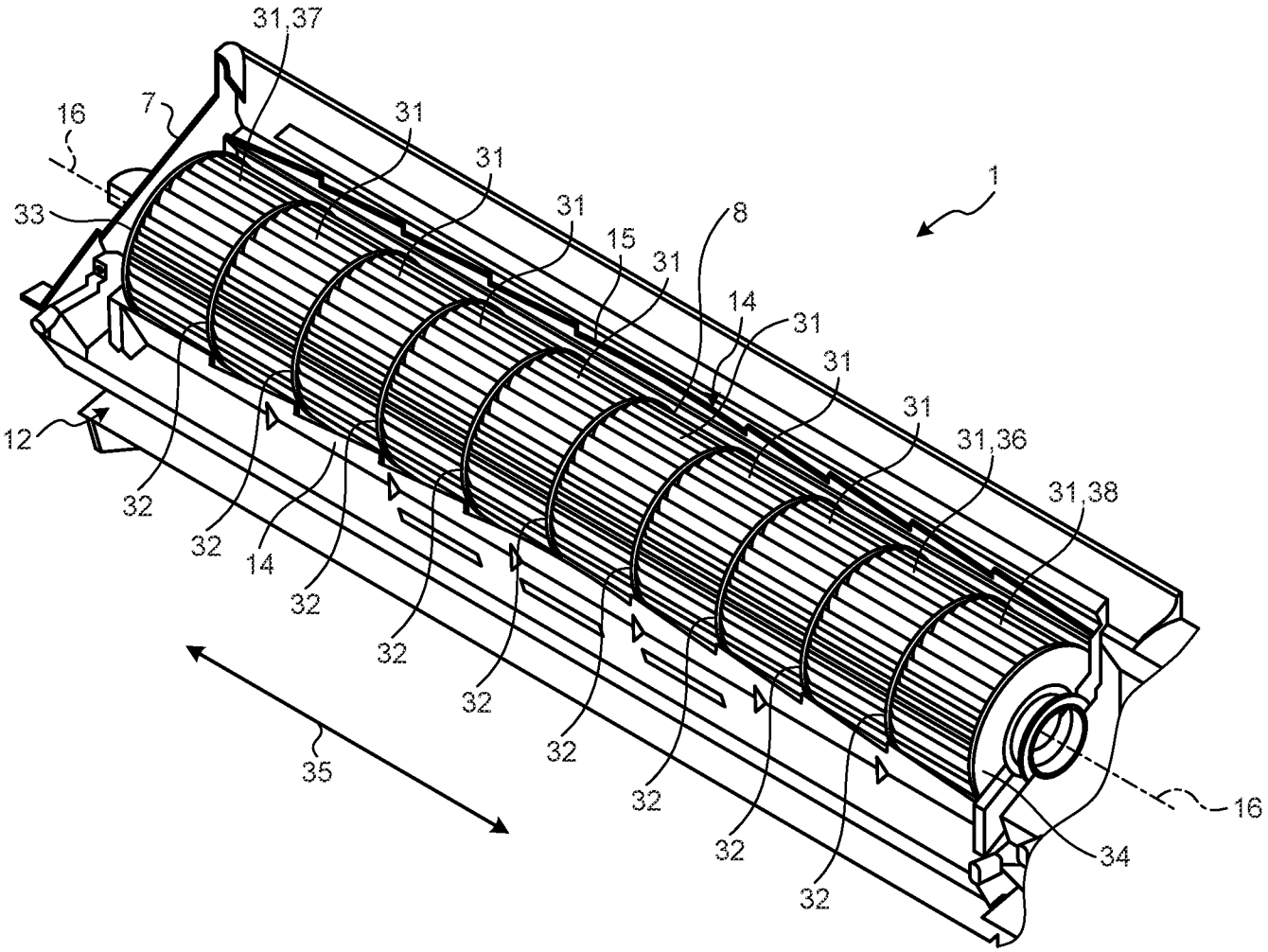
FIG. 2 is a perspective view of the blower of the embodiment.

FIG. 2 is a perspective view of the blower 1 of the embodiment. The cross flow fan 8 is generally formed in a cylindrical shape. The cross flow fan 8 is arranged in the blowing passage 11 such that the cross flow fan 8 is along a longitudinal direction (an axial direction 35 in the figure) of the fan casing 7, and the cross flow fan 8 is supported by the fan casing 7 such that the cross flow fan 8 is rotatable about a rotation axis 16. The cross flow fan 8 includes a plurality of impellers 31, a plurality of partition plates 32, a first end plate 33, and a second end plate 34. The plurality of impellers 31 are arranged in the axial direction 35 parallel to the rotation axis 16 and are fixed to each other via the plurality of partition plates 32. One impeller 36 of the plurality of impellers 31 includes, as illustrated in FIG. 1, a plurality of blades 41. Each of the plurality of blades 41 is formed in a so-called streamline shape. The plurality of blades 41 are arranged in a circumferential direction, with the rotation axis 16 being in the center. Each of the plurality of blades 41 is arranged along a straight line parallel to the rotation axis 16. Another impeller of the plurality of impellers 31 includes, similarly to the impeller 36, the plurality of blades 41, this other impeller being different from the impeller 36.

The plurality of partition plates 32 are each generally formed in a circular plate shape. The plurality of partition plates 32 are respectively arranged, as illustrated in FIG. 2, along a plurality of planes orthogonal to the rotation axis 16. Each of the plurality of partition plates 32 is arranged between two impellers of the plurality of impellers 31 and is fixed to the plurality of blades 41 of these two impellers.

The first end plate 33 is generally formed in a circular plate shape. The first end plate 33 is arranged at one end of the cross flow fan 8 such that the first end plate 33 is along a plane orthogonal to the rotation axis 16, and the first end plate 33 is fixed to the plurality of blades 41 of a first impeller 37 arranged at one end of the plurality of impellers 31. The second end plate 34 is generally formed in a circular plate shape. The second end plate 34 is arranged at the other end of the cross flow fan 8 such that the second end plate 34 is along a plane orthogonal to the rotation axis 16, and the second end plate 34 is fixed to the plurality of blades 41 of a second impeller 38 arranged at the other end of the plurality of impellers 31. The third impeller 36 of the plurality of impellers 31 is arranged between the first impeller 37 and the second impeller 38, the third impeller 36 being different from the first impeller 37 and the second impeller 38.

The blower 1 further includes a motor unit not illustrated in the drawings. The motor unit is a mechanism that rotates the cross flow fan 8 in a rotation direction 40, which has been determined beforehand, about the rotation axis 16, as illustrated in FIG. 1. Each of the plurality of impellers 31 is formed so that rotation of the cross flow fan 8 in the rotation direction 40 causes air to flow in the blowing passage 11 toward the outlet 12.

Figure 3:
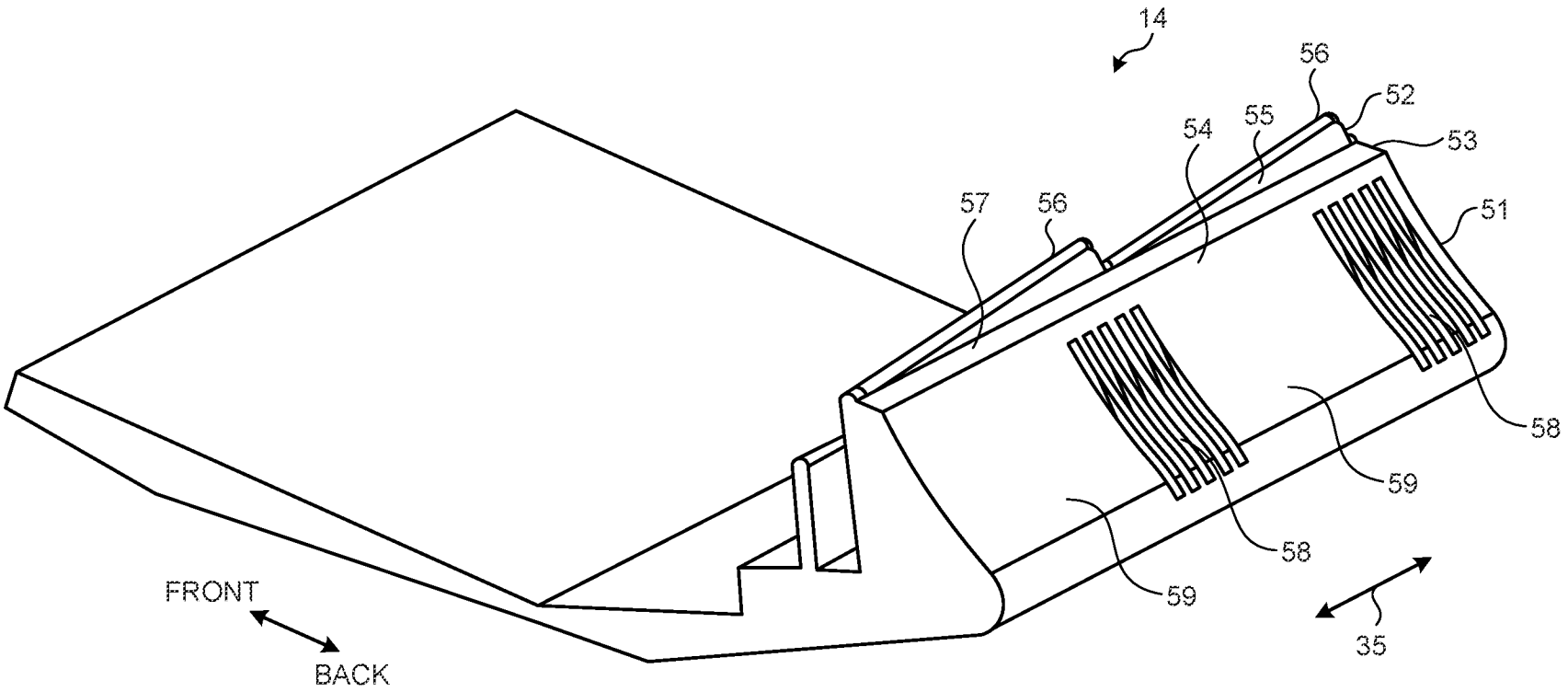
FIG. 3 is a perspective view of a portion of a front tongue part, the portion corresponding to two impellers.

FIG. 3 is a perspective view of a portion of the front tongue part 14, the portion corresponding to two impellers. The position, along the axial direction 35, of the portion of the front tongue part 14, the portion corresponding to the two impellers, is equal to the position, along the axial direction 35, of the two impellers. The front tongue part 14 includes a main body portion 51, a distal end portion 52, and a stepped portion 53. The main body portion 51 has a front fan facing surface 54 formed thereon. The front fan facing surface 54 is formed to be generally along a side surface of a cylinder having the rotation axis 16 as its central axis. The front fan facing surface 54 faces the cross flow fan 8 and faces the back tongue part 15 with the cross flow fan 8 interposed between the front fan facing surface 54 and the back tongue part 15. The distal end portion 52 is a portion formed at an upper end of the front tongue part 14 and is arranged on the upper side of the main body portion 51. The distal end portion 52 has, formed thereon, a distal end fan facing surface 55 facing the cross flow fan 8. The distal end fan facing surface 55 is formed in front of the front fan facing surface 54 such that a distance between the distal end fan facing surface 55 and the rotation axis 16 is longer than a distance between the front fan facing surface 54 and the rotation axis 16.

The distal end portion 52 further has the plurality of protruding portions 56 formed thereon. The plurality of protruding portions 56 are formed such that an upper end of the distal end portion 52 is formed in a saw-toothed shape. That is, the plurality of protruding portions 56 are formed to protrude upward from the upper end of the front tongue part 14 and are arranged in the axial direction 35 at predetermined intervals. Furthermore, the plurality of protruding portions 56 are formed such that one protruding portion of the plurality of protruding portions 56 is formed at a portion of the front tongue part 14, the portion corresponding to one impeller.

The stepped portion 53 is formed between the main body portion 51 and the distal end portion 52, of the front tongue part 14. The stepped portion 53 has a step surface 57 formed thereon, the step surface 57 being along a straight line parallel to the rotation axis 16. The step surface 57 is connected to the front fan facing surface 54 and is connected to the distal end fan facing surface 55.

The front fan facing surface 54 includes the plurality of front non-flat portions 58 and the plurality of front flat portions 59. The plurality of front non-flat portions 58 and the plurality of front flat portions 59 are alternately arranged in the axial direction 35 such that one front flat portion of the plurality of front flat portions 59 is arranged between two front non-flat portions of the plurality of front non-flat portions 58. That is, the plurality of front non-flat portions 58 are arranged in the axial direction 35 at predetermined intervals such that one front non-flat portion of the plurality of front non-flat portions 58 is formed at a portion of the front tongue part 14, the portion corresponding to the impeller 36. The plurality of front flat portions 59 are arranged in the axial direction 35 at predetermined intervals such that one front flat portion of the plurality of front flat portions 59 is formed at a portion of the front tongue part 14, the portion corresponding to one impeller.

Each of the plurality of front non-flat portions 58 has a plurality of grooves formed thereon. The plurality of grooves are formed to be recessed from the front fan facing surface 54 and is formed to be along a plurality of parallel lines. The plurality of parallel lines are parallel to a plane that the front fan facing surface 54 is along and are orthogonal to the rotation axis 16. Each of the plurality of front flat portions 59 is formed to be along a side surface of a cylinder having the rotation axis as its central axis and is formed smoothly with no non-flatness formed thereon.

Figure 4:
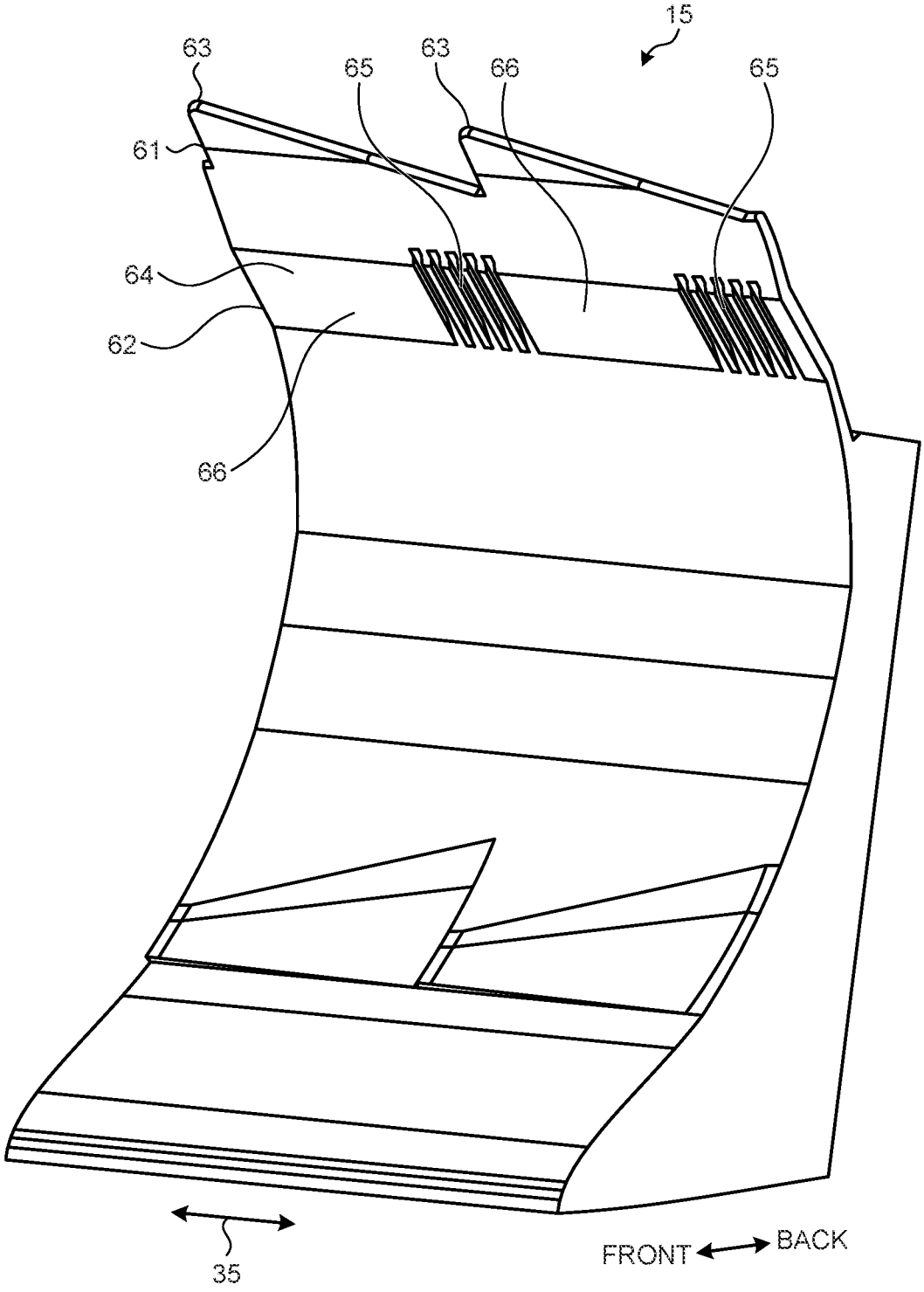
FIG. 4 is a perspective view of a portion of a back tongue part, the portion corresponding to two impellers.

FIG. 4 is a perspective view of a portion of the back tongue part 15, the portion facing two impellers. The position, along the axial direction 35, of the portion of the back tongue part 15, the portion corresponding to the two impellers, is equal to the position, along the axial direction 35, of the two impellers. The back tongue part 15 includes a distal end portion 61 and a main body portion 62. The distal end portion 61 is a portion formed at an upper end of the back tongue part 15. The distal end portion 61 has a plurality of protruding portions 63 formed thereon. The plurality of protruding portions 63 are formed such that an upper end of the distal end portion 61 is formed in a saw-toothed shape. That is, the plurality of protruding portions 63 are formed to protrude upward from the upper end of the back tongue part 15 and are arranged in the axial direction 35 at predetermined intervals. Furthermore, the plurality of protruding portions 63 are formed such that one protruding portion of the plurality of protruding portions 63 is formed at a portion of the back tongue part 15, the portion corresponding to one impeller.

The main body portion 62 has a back fan facing surface 64 formed thereon. The back fan facing surface 64 is formed to be generally along a side surface of a cylinder having the rotation axis 16 as its central axis. The back fan facing surface 64 faces the cross flow fan 8 and faces the front tongue part 14 with the cross flow fan 8 interposed between the back fan facing surface 64 and the front tongue part 14. The back fan facing surface 64 includes a plurality of back non-flat portions 65 and a plurality of back flat portions 66. The plurality of back non-flat portions 65 and the plurality of back flat portions 66 are alternately arranged in the axial direction 35 such that one back flat portion of the plurality of back flat portions 66 is arranged between two back non-flat portions of the plurality of back non-flat portions 65. That is, the plurality of back non-flat portions 65 are arranged in the axial direction 35 at predetermined intervals such that one back non-flat portion of the plurality of back non-flat portions 65 is formed at a portion of the back tongue part 15, the portion corresponding to one impeller. The plurality of back flat portions 66 are arranged in the axial direction 35 at predetermined intervals such that one back flat portion of the plurality of back flat portions 66 is formed at a portion of the back tongue part 15, the portion corresponding to the one impeller 36.

Each of the plurality of back non-flat portions 65 has a plurality of grooves formed thereon. The plurality of grooves are formed to be along a plurality of parallel lines and are formed to be recessed from the back fan facing surface 64. The plurality of parallel lines are parallel to a plane that the back fan facing surface 64 is along and are perpendicular to the rotation axis 16. Each of the plurality of back flat portions 66 is formed to be along a side surface of a cylinder having the rotation axis 16 as its central axis and is formed smoothly with no non-flatness formed thereon.

Figure 5:
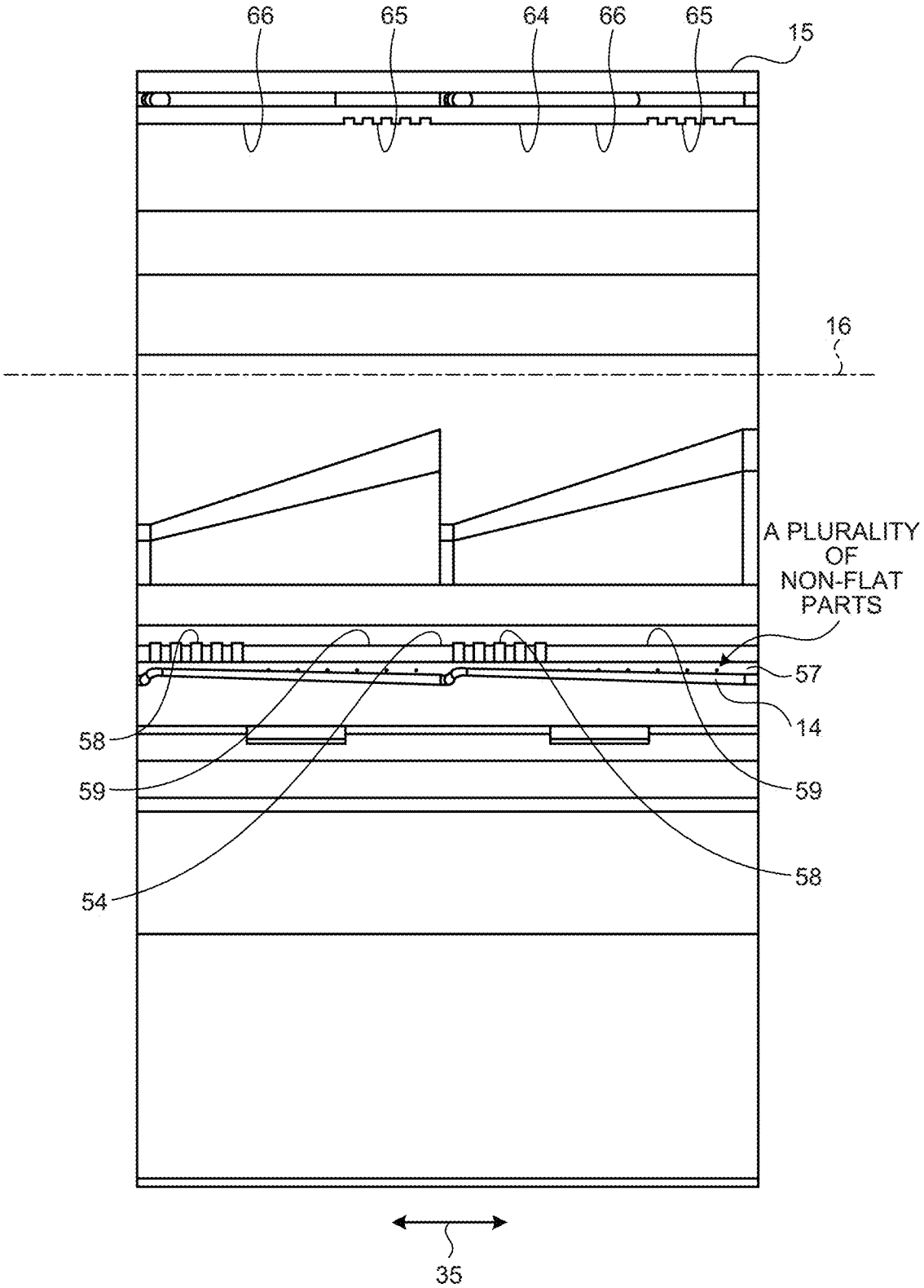
FIG. 5 is a perspective view of the front tongue part and the back tongue part.

FIG. 5 is a perspective view of the front tongue part 14 and the back tongue part 15. The back fan facing surface 64 is formed such that the plurality of back non-flat portions 65 face the plurality of front flat portions 59 of the front tongue part 14 and the plurality of back flat portions 66 face the plurality of front non-flat portions 58 of the front tongue part 14. That is, the positions, along the axial direction 35, of the plurality of back non-flat portions 65 are equal to the positions, along the axial direction 35, of the plurality of front flat portions 59. The positions, along the axial direction 35, of the plurality of back flat portions 66 are equal to the positions, along the axial direction 35, of the plurality of front non-flat portions 58.

Operation of Air Conditioner

The air conditioner circulates a refrigerant between the indoor unit 10 and the outdoor unit. The outdoor unit carries out heat exchange between the refrigerant and outside air. The blower 1 rotates the cross flow fan 8 in the rotation direction 40 about the rotation axis 16. The blower 1 supplies air in the air conditioned room from the inlet 6 of the indoor unit 10 into the air passage 5, by this rotation of the cross flow fan 8. The heat exchanger 3 carries out heat exchange between the air supplied from the inlet 6 to the air passage 5 and the refrigerant to adjust temperature of the air supplied to the air passage 5. The air having the temperature adjusted by the heat exchanger 3 is blown out to the air conditioned room from the outlet 12. The air conditioner is able to cool or heat the air conditioned room in which the indoor unit 10 has been installed, by such operation.

The blower 1 enables reduction of disturbance to flow of air entering the blowing passage 11 and reduction of noise, by having the step surface 57 formed on the front tongue part 14. The blower 1 enables further reduction of the disturbance to the flow of the air entering the blowing passage 11 and further reduction of the noise, by having the plurality of protruding portions 56 formed at the distal end of the front tongue part 14. The blower 1 enables further reduction of the disturbance to the flow of the air entering the blowing passage 11 and further reduction of the noise, by having the plurality of protruding portions 63 formed at the distal end of the back tongue part 15.

When the cross flow fan 8 rotates and passes near the front fan facing surface 54, that is, by each of the plurality of blades 41 coming closer to the front fan facing surface 54 and going away from the front fan facing surface 54, pressure fluctuates in a region between the front fan facing surface 54 and the cross flow fan 8. In this region, blade pitch noise is generated due to this fluctuation in pressure. This blade pitch noise is also called nz sound and is a noise component having a fundamental frequency that is the number of blades □ the rotation number. Noise components includes, in addition to front blade pitch noise, front wind noise generated due to disturbance to airflow generated between the cross flow fan 8 and the heat exchanger 3 in the front. Frequency of the front wind noise changes according to the velocity of flow of air between the cross flow fan 8 and the heat exchanger 3 in the front. The front wind noise includes front non-flat side wind noise and front flat side wind noise. The front flat side wind noise is different from the front non-flat side wind noise. Specifically, having the plurality of front non-flat portions 58 means that portions (grooves) at a larger distance from the cross flow fan 8 as compared to a flat case (the plurality of front flat portions 59) have been formed; and because the larger this distance, the smaller the velocity of flow of air and the frequency of the front wind noise changes according to the flow velocity, the frequency of the front flat side wind noise is different from the frequency of the front non-flat side wind noise. If the front fan facing surface 54 were a flat surface from one end to the other end, in the axial direction 35, of the front fan facing surface 54, the flat surface having no groove shapes like the plurality of front non-flat portions 58 formed thereon, wind noise of a certain frequency would be generated from one end to the other end, in the axial direction 35, in the heat exchanger 3 in the front, and the noise level would thus become high, and if that frequency were to overlap the frequency of the blade pitch noise, the noise level would be increased even more. The techniques in the present disclosure enable reduction of portions that become a sound source that resonates with the blade pitch noise and thus reduce noise caused by resonant sound. By the front non-flat side wind noise and the front flat side wind noise being different from each other, the blower 1 enables reduction of portions that become a sound source that resonates with the blade pitch noise and enables reduction of increase in the noise level.

Back wind noise is generated between the back fan facing surface 64 and the cross flow fan 8, due to disturbance in airflow. Frequency of the back wind noise changes according to the velocity of flow of air between the cross flow fan 8 and the heat exchanger 3 in the back. The back wind noise includes back non-flat side wind noise and back flat side wind noise. Back flat side wind noise is different from back non-flat side wind noise. Specifically, having the plurality of back non-flat portions 65 means that portions (grooves) at a larger distance from the cross flow fan 8 as compared to a flat case (the plurality of back flat portions 66) have been formed. Because the larger this distance, the smaller the velocity of flow of air, and the frequency of the blade pitch noise changes according to the flow velocity; the frequency of the back flat side wind noise is different from the frequency of the back non-flat side wind noise. Specifically, having the plurality of back non-flat portions 65 means that portions (grooves) at a larger distance from the cross flow fan 8 as compared to a flat case (the plurality of back flat portions 66) have been formed; and because the larger this distance, the smaller the velocity of flow of air and the frequency of the back wind noise changes according to the flow velocity, the frequency of the back flat side wind noise is different from the frequency of the back non-flat side wind noise. Similarly to the front wind noise, portions that become a sound source that resonates with the blade pitch noise are able to be reduced and noise caused by resonant sound is thus reduced. By the back non-flat side wind noise and the back flat side wind noise being different from each other, the blower 1 enables reduction of portions that become a sound source that resonates with the blade pitch noise and enables reduction of increase in the noise level.

Effects of Blower 1 of Embodiment

The blower 1 of the embodiment includes the cross flow fan 8, the mechanism that rotates the cross flow fan 8 about the rotation axis 16, the front tongue part 14 arranged in front of the cross flow fan 8, and the back tongue part 15 arranged in back of the cross flow fan 8. The front fan facing surface 54 of the front tongue part 14, the front fan facing surface 54 facing the cross flow fan 8, includes the plurality of front non-flat portions 58 having the non-flatness formed thereon, and the plurality of front flat portions 59 having no non-flatness formed thereon. The back fan facing surface 64 of the back tongue part 15, the back fan facing surface 64 facing the cross flow fan 8, includes the plurality of back non-flat portions 65 having the non-flatness formed thereon, and the plurality of back flat portions 66 having no non-flatness formed thereon. The plurality of back non-flat portions 65 respectively face the plurality of front flat portions 59, with the cross flow fan 8 interposed between the plurality of back non-flat portions 65 and the plurality of front flat portions 59. The plurality of back flat portions 66 respectively face the plurality of front non-flat portions 58, with the cross flow fan 8 interposed between the plurality of back flat portions 66 and the plurality of front non-flat portions 58.

The blower 1 of the embodiment enables shift of the timing of generation of the blade pitch noise generated between the cross flow fan 8 and the front tongue part 14 to reduce the noise level and enables shift of the timing of generation of the blade pitch noise generated between the cross flow fan 8 and the back tongue part 15, by having the non-flatness formed on the front tongue part 14 and having the non-flatness formed on the back tongue part 15. The plurality of front non-flat portions 58 and the plurality of back non-flat portions 65 have the portions (grooves) at larger distances from the cross flow fan 8 and thus have the effect of decreasing the flow velocity of air. If the plurality of front non-flat portions 58 were to face the plurality of back non-flat portions 65, the flow velocity could be excessively decreased, the flow could thus be destabilized, and surging could thus be caused. In the blower 1 of the embodiment, the plurality of front non-flat portions 58 face the plurality of back flat portions 66 and the plurality of front flat portions 59 face the plurality of back non-flat portions 65. Surging is thereby able to be prevented and degradation of the blowing performance is thus able to be reduced.

The plurality of front non-flat portions 58 and the plurality of back non-flat portions 65 in the blower 1 of the embodiment described already have the plurality of grooves formed thereon, the plurality of grooves being recessed from the front fan facing surface 54 or the back fan facing surface 64, but other structures different from these plurality of grooves may be formed instead. Examples of these other structures include plurality of ribs protruding from the front fan facing surface 54 or the back fan facing surface 64. In effect, any structure that causes a distance between the front tongue part 14 (back tongue part 15) and the cross flow fan 8 to be different from that between the plurality of front flat portions 59 (the plurality of back flat portions 66) and the cross flow fan 8 may be adopted. A blower having such a structure formed therein enables reduction of the blade pitch noise and reduction of degradation of the blowing performance, similarly to the blower 1 of the embodiment described already.

Each of the plurality of impellers 31 of the cross flow fan 8 in the blower 1 of the embodiment described already faces one front non-flat portion of the plurality of front non-flat portions 58 but may face two or more front non-flat portions of the plurality of front non-flat portions 58. Furthermore, each of the plurality of impellers 31 faces one back non-flat portion of the plurality of back non-flat portions 65 but may face two or more back non-flat portions of the plurality of back non-flat portions 65. A blower having the plurality of impellers 31 each facing two or more front non-flat portions and facing two or more back non-flat portions also enables reduction of increase in the noise level and reduction of degradation of the blowing performance, similarly to the blower 1 of the embodiment described already.

Furthermore, the front tongue part 14 of the blower 1 of the embodiment has indentations formed at the distal end of the front tongue part 14, and the back tongue part 15 has indentations formed at the distal end of the back tongue part 15. The blower 1 of the embodiment thus enables reduction of disturbance to the flow of air entering the blowing passage 11 and reduction of the noise. The indentations are formed at the distal ends of the front tongue part 14 and the back tongue part 15 in the blower 1 of the embodiment described already, but no indentations may be formed. A blower having no indentations formed at the distal end of the front tongue part 14 and the distal end of the back tongue part 15 also enables less increase in the noise level and less degradation of the blowing performance, similarly to the blower 1 of the embodiment described already.

Furthermore, the front fan facing surface 54 in the blower 1 of the embodiment has the step surface 57 formed along a straight line parallel to the rotation axis 16. Because the step surface 57 has been formed in the blower 1 of the embodiment, a small vortex is formed by air flowing into space facing the front fan facing surface 54 and the step surface 57. This small vortex enables reduction of disturbance to the flow of air entering the blowing passage 11 and reduction of the noise. Furthermore, a plurality of grooves may be formed around the boundary between the step surface 57 and the distal end fan facing surface 55 of the front tongue part 14 in the blower 1 of the embodiment. A blower having such a plurality of grooves formed thereon enables further reduction of disturbance to the flow of air entering the blowing passage 11 and further reduction of the noise.

The blower 1 of the embodiment described already has the step surface 57 formed between the front fan facing surface 54 and the distal end fan facing surface 55, but no step may be formed between the front fan facing surface 54 and the distal end fan facing surface 55. That is, both the front fan facing surface 54 and the distal end fan facing surface 55 may be formed along the side surface of the cylinder having the rotation axis as its central axis. A blower without a step between the front fan facing surface 54 and the distal end fan facing surface 55 also enables less increase in the noise level and less degradation of the blowing performance, similarly to the blower 1 of the embodiment described already.

The blower 1 of the embodiment described already is used in the indoor unit 10 of the air conditioner but may be used in another apparatus different from the indoor unit 10. Examples of that other apparatus include an air curtain apparatus. In this case also, the blower 1 enables reduction of increase in the noise level and reduction of degradation of the blowing performance.

The embodiment has been described above, but the embodiment is not limited by what has been described above. Furthermore, the components described above include those readily supposed by a person skilled in the art, those that are substantially the same, and those of so-called equivalent scope. In addition, the components described above may be combined as appropriate. Furthermore, without departing from the gist of the embodiment, at least one selected from a group including various omissions, substitutions, and modifications of the components may be made.

REFERENCE SIGNS LIST

1 BLOWER
2 CASING
3 HEAT EXCHANGER
7 FAN CASING
8 CROSS FLOW FAN
10 INDOOR UNIT
11 BLOWING PASSAGE
12 OUTLET
14 FRONT TONGUE PART
15 BACK TONGUE PART
16 ROTATION AXIS
31 IMPELLERS
35 AXIAL DIRECTION
41 BLADES
54 FRONT FAN FACING SURFACE
58 FRONT NON-FLAT PORTIONS
59 FRONT FLAT PORTIONS
64 BACK FAN FACING SURFACE
65 BACK NON-FLAT PORTIONS
66 BACK FLAT PORTIONS

The invention claimed is:

1. A blower, comprising:
a cross flow fan;
a motor configured to rotate the cross flow fan about a rotation axis;
a front tongue part that is arranged in front of the cross flow fan; and
a back tongue part that is arranged in back of the cross flow fan, wherein
a front fan facing surface of the front tongue part, the front fan facing surface facing the cross flow fan, consists of:
a plurality of front non-flat portions on which non-flatness is formed; and
a plurality of front flat portions on which no non-flatness formed,
a back fan facing surface of the back tongue part, the back fan facing surface facing the cross flow fan, consists of:
a plurality of back non-flat portions on which non-flatness formed; and
a plurality of back flat portions on which no non-flatness formed,
the plurality of back non-flat portions respectively face the plurality of front flat portions, with the cross flow fan interposed between the plurality of back non-flat portions and the plurality of front flat portions,
the plurality of back flat portions respectively face the plurality of front non-flat portions, with the cross flow fan interposed between the plurality of back flat portions and the plurality of front non-flat portions, and
the front tongue part and the back tongue part are formed such that the plurality of back non-flat portions do not face the plurality of front non-flat portions.

2. The blower according to claim 1, wherein
the plurality of front non-flat portions have grooves that are recessed from the front fan facing surface, and
the plurality of back non-flat portions have grooves that are recessed from the back fan facing surface.

3. The blower according to claim 1, wherein
the cross flow fan has a plurality of impellers arranged parallel to the rotation axis, and
each of the plurality of impellers
faces at least one front non-flat portion of the plurality of front non-flat portions, and
faces at least one back non-flat portion of the plurality of back non-flat portions.

4. The blower according to claim 1, wherein
the front tongue part has indentations formed at a distal end of the front tongue part, and
the back tongue part has indentations formed at a distal end of the back tongue part.

5. The blower according to claim 1, wherein
the front fan facing surface has a step that is formed along a straight line parallel to the rotation axis, and
the step has a plurality of non-flat parts that are arranged parallel to the rotation axis.

6. An indoor unit, comprising:
a heat exchanger; and
the blower according to claim 1 that blows air that has passed through the heat exchanger.

7. A blower, comprising:
a cross flow fan;

a motor configured to rotate the cross flow fan about a rotation axis;

a front tongue part that is arranged in front of the cross flow fan; and a back tongue part that is arranged in back of the cross flow fan, wherein a front fan facing surface of the front tongue part, the front fan facing surface facing the cross flow fan, includes:

a plurality of front non-flat portions on which non-flatness is formed; and a plurality of front flat portions on which no non-flatness formed, a back fan facing surface of the back tongue part, the back fan facing surface facing the cross flow fan, includes:

a plurality of back non-flat portions on which non-flatness formed; and a plurality of back flat portions on which no non-flatness formed, the plurality of back non-flat portions respectively face the plurality of front flat portions, with the cross flow fan interposed between the plurality of back non-flat portions and the plurality of front flat portions, the plurality of back flat portions respectively face the plurality of front non-flat portions, with the cross flow fan interposed between the plurality of back flat portions and the plurality of front non-flat portions, the front fan facing surface has a step that is formed along a straight line parallel to the rotation axis, and the step has a plurality of non-flat parts that are arranged parallel to the rotation axis.

* * * * *